US007472445B2

(12) United States Patent
Miller

(10) Patent No.: US 7,472,445 B2
(45) Date of Patent: Jan. 6, 2009

(54) ASSIST DEVICE FOR GETTING INTO AND OUT OF SITTING OR PRONE POSITIONS ON BEDS AND SIMILAR FURNITURE

(75) Inventor: Troy Miller, Logan, UT (US)

(73) Assignee: Standers, Inc., Logan, UT (US)

( * ) Notice: Subject to any disclaimer, the term of this patent is extended or adjusted under 35 U.S.C. 154(b) by 0 days.

(21) Appl. No.: 11/372,779

(22) Filed: Mar. 10, 2006

(65) Prior Publication Data

US 2006/0253990 A1 Nov. 16, 2006

(51) Int. Cl.
*A61G 7/053* (2006.01)

(52) U.S. Cl. ..... 5/662; 5/652

(58) Field of Classification Search ..... 5/658, 5/662, 424, 430
See application file for complete search history.

(56) References Cited

U.S. PATENT DOCUMENTS

| | | | | |
|---|---|---|---|---|
| 1,862,237 | A | 6/1932 | Pepler | |
| 2,612,422 | A | 9/1952 | Sarkas | 311/27 |
| 4,724,559 | A | 2/1988 | Bly et al. | 5/425 |
| 4,932,090 | A | 6/1990 | Johansson | 5/445 |
| 5,337,430 | A | 8/1994 | Schlein | 5/662 |
| 5,359,741 | A | 11/1994 | Lang | 5/507.1 |
| 5,400,450 | A | 3/1995 | Leoutsakos | 5/662 |
| 5,448,791 | A | 9/1995 | Brown | 5/662 |
| 5,507,044 | A | 4/1996 | Williamson et al. | 5/81.1 |
| 5,586,352 | A | 12/1996 | O'Brien et al. | 5/662 |
| 5,671,490 | A * | 9/1997 | Wu | 5/426 |
| 5,781,945 | A * | 7/1998 | Scherer et al. | 5/426 |
| 5,787,530 | A | 8/1998 | Brix | 5/662 |
| 5,806,548 | A | 9/1998 | Goldstein et al. | 135/65 |
| 6,134,731 | A * | 10/2000 | Thom et al. | 5/662 |
| 6,138,301 | A | 10/2000 | Battiston | 5/81.1 R |
| 6,240,583 | B1 * | 6/2001 | Brooke et al. | 5/662 |
| 6,311,942 | B1 * | 11/2001 | Rotter et al. | 248/316.5 |
| 6,401,280 | B1 * | 6/2002 | Baker | 5/662 |
| 6,519,794 | B1 | 2/2003 | Aarestad et al. | 5/430 |

* cited by examiner

*Primary Examiner*—Fredrick Conley
(74) *Attorney, Agent, or Firm*—Stoel Rives LLP

(57) ABSTRACT

A device for assisting a user in getting into and out of sitting and prone positions on a piece of furniture, like a bed, which has a large base to fit between the mattress and box springs of a bed and that includes a receiving portion and an adjustable handle for the user to grasp while getting into an out of bed and while adjusting positions in the bed.

11 Claims, 16 Drawing Sheets

ASSIST DEVICE FOR GETTING INTO AND OUT OF SITTING OR PRONE POSITIONS ON BEDS AND SIMILAR FURNITURE

1. RELATED APPLICATIONS

This application claims the benefit of U.S. patent application Ser. No. 10/764,903, filed Jan. 26, 2004, and entitled ASSIST DEVICE FOR GETTING INTO AND OUT OF SITTING OR PRONE POSITIONS ON BEDS AND SIMILAR FURNITURE, which claims the benefit of U.S. patent application Ser. No. 09/150,268, filed Sep. 9, 1998, which is abandoned, and entitled ASSIST DEVICE FOR GETTING INTO AND OUT OF SITTING POSITIONS, both of which are incorporated herein by reference.

2. Field of the Illustrated Embodiments

This invention relates generally to the field of medical and ambulatory assist devices and equipment, and more specifically, to a novel device for assisting individuals with disabilities and affirmatives incident to accidents, diseases, age or other causes to get up from and recline into sitting and/or prone positions on a bed or other object designed to lie down or sleep on.

3. Background of the Illustrated Embodiments

Devices and methods for assisting people to get up from and recline into sitting and/or prone positions are well known in the art. These devices tend to fall into two broad categories. The first general category consists of devices that are roughly fixated to a standard bed or like piece of furniture. The second general category consists of devices that mechanically raise and lower. These include beds an like pieces of furniture that contain motors which area designed to raise and lower the respective furniture to allow a person to either stand up or sit or lie down.

In most instances. The first general category of devices has some sort of a handle that is attached to a base. The base in turn anchors in some manner to a bed or like piece of furniture. The handle extends up above the level of the bed or other piece of furniture allowing the user to grab the handle to either get up from and/or recline into the bed.

While adequate for a number of applications, the type of devices just described also includes a number of disadvantages. For example, most of these devices have handles that are immovably fixed to the base. This can cause the device to awkward to store or transport. In order to overcome this problem the device might have to be disassembled which might result in lost or damaged parts.

A further disadvantage is that the handle of most comparable devices is that they are awkward in shape and difficult for individuals using the device to grab a hold of and to adjust their hand positions once they have grabbed the handle. That is, the handles of most devices do not resemble any type of device that the users are familiar with or used to using, or they offer no advantage to the user to manipulate his or her hand positions for ease of use.

An additional disadvantage of the handle on the first category of devices is that they are small and do not offer the user a large surface upon which to place his or her hand or arm. Thus, as set forth above, the handle can be difficult to grab and does not offer the user any significant advantage over simply pushing him or herself up.

Still a further disadvantage of the first category of devices is that the attaching means generally used are specific to a particular type of bed or like furniture. Thus, the device will not be able to be used on all or most beds or like pieces of furniture.

Still another disadvantage of this first category of devices is that the means to attach the device to the bed or other piece of furniture does not secure the device in place. Thus, the device can move or become unstable and even dangerous during use.

While also adequate for a number of applications, the second general category of devices described above also include a number of disadvantages. For example, the cost of such devices is prohibitive for most individuals, especially these on fixed incomes. In most instances, these devices cost thousands of dollars and are out of reach of most individuals who find themselves in need of such devices.

Another disadvantage of this type of device is that they are somewhat dangerous when in operation. That is, the mechanical device generally lifts a person to a sitting or standing positions at which point there is no further support for the individual. Most of these devices so not have any bars or handles that a person can grab a hold of as they attempt to sit or stand. When the device reaches its highest point, the person operating the device must be ready and able to sit or stand on their own there is no going back. If the person is not ready at the instant, there is a strong likelihood that they might stumble and fall.

A further disadvantage of these devices is that they are dependent. If there is a power outage the device will not operate. As is obvious, at the time when a power outage occurs there may be a critical need for an injured or infirm person to get help to avoid problems that might be associated with the power outage such as the ability to heat or cool a home. However, it is precisely at this time that the device will not work, thus rendering the user vulnerable to such conditions.

Additional features and advantages will become apparent in studying the ensuing drawings and description.

BRIEF SUMMARY OF THE ILLUSTRATED EMBODIMENTS

In light of the problems described in the prior art, the present invention seeks to accomplish and realize, among other things, the following objects and advantages.

A principal aspect of the present invention is to provide a novel device to assist individuals to get up from and recline into sitting and/or prone positions on a bed or other object designed to lie down or sleep on which has a handle that is adjustable for ease of storage and transport.

Another major aspect of the present invention is to provide novel device to assist individuals to get up from and recline into sitting and/or prone positions on a bed or other object designed to lie down or sleep on that has a handle that can grab a hold of and adjust their hand positions during use as necessary.

Still another aspect of the invention is to provide a novel device to assist individuals to get up from and recline into sitting and/or prone positions on a bed or other object designed to lie down or sleep on that has a handle that is large and that provides a mini-rail next to the bed to allow the user the most advantage possible while in use.

Yet another major aspect of the invention is to provide a novel device to assist individuals to get up from and recline into a sitting and/or prone positions on a bed or other object designed to lie down or sleep on that has an attaching means that will attach to various types of beds or like furniture.

Still another important aspect of the invention is to provide a novel device to assist individuals to get up from and recline into sitting and/or prone positions on a bed or other object designed to lie down or sleep on that has a means to securely attach to a bed or like furniture for ease of operation and safety.

Still another principal aspect of the present invention a novel device to assist individuals to get up from and recline into sitting and/or prone positions on a bed or other object designed to lie down or sleep on that has a handle and base that can be folded in relation to each other to provide for ease of transport and storage.

It is a further aspect of this invention to provide a novel device to assist individuals to get up from and recline into sitting and/or prone positions on a bed or other object designed to lie down or sleep on that is inexpensive and is accessible to the general public and to those on fixed incomes.

It is still a further aspect of this invention is to provide a novel device to assist individuals to get up from and recline into sitting and/or prone positions on a bed or other object designed to lie down or sleep on that allows a person to stand up, sit down or lie down slowly and fully supported during the entire procedure.

Another important aspect of this invention is to provide a novel device to assist individuals to get up from and recline into sitting and/or prone positions on a bed or other object designed to lie down or sleep on that is not dependent upon electricity and therefore will not compromise the users in the event that there is a power outage.

These and other aspect and advantages of the invention will become more fully apparent from the description and the claims which follow, or may be learned by the practice of the invention.

Accordingly, another embodiment of the present invention comprises generally, a base, a handle, a bracket for hingeable attaching to handle to the base and a strap for securing the device to the bed or like furniture.

At present preference the base consists of a large planer member that is designed to fit between the mattress and box springs on a bed or like piece of furniture. The base is advantageously designed to be large enough to provide a firm and stable base for the operation of the device. The base further consists of top and bottom broad faces, as well as first and second longitudinal ends and first and second longitudinal sides. Advantageously, the base is constructed out of rigid non-flexing material such as wood. Other material such as wood composites, plastics, polymers, steel, aluminum and the like are also contemplated and fall within the purview and scope of this patent.

Advantageously, the handle includes a first and second end. The first end of the handle is advantageously shaped to provide a mini-rail that, when in place, extends above and horizontal to and parallel to the top of the mattress. The first end of the handle is covered or coated with a material that prevents slippage of the users hand on the device as well as provides for the comfort of the user during operation of the device. The second end of the handle contains a plurality of holes or perforations. The second end of the handle includes a plurality of holes or perforations and is advantageously designed to be permanently and hingeably attached to the bracket in a manner that allows it to hinge relative to base.

Also, at present preference, the bracket includes a u-shaped bracket portion that is designed to accept an edge portion of the base and a u-shaped portion that is designed to permanently and hingeably accept the send end of the handle. The two u-shaped portions of the bracket are oriented in a manner such that the bottom portions of the "u" are back to back and they bear a ninety degree relationship to each other. The u-shaped portion of the bracket that is designed to permanently and hingeably accept the second end of the handle includes first and second ends. The first end (or top end) of the u-shaped bracket that is designed to permanently and hingeably accept the second end of the handle includes a plurality of holes or perforations. A bolt is used to pass through this plurality of holes or perforations, through the plurality of holes or perforations in the second end of the handle, where it is permanently affixed. This creates a pivot point for the handle that allows it to hinge relative to the base. The second end (or bottom end) of the u-shaped portion of the bracket that is designed to permanently and hingeably accept the second end of the handle contains a plurality of holes or perforations. A pin type means is used to pass through the plurality of holes or perforations, through the plurality of holes or perforations in the second end of the handle, where it affixes the handle in a ninety-degree orientation to the base.

Further, at present preference, the strap or securing means comprises a strap. The strap is advantageously designed of material that is strong and durable such as nylon or flexible metal material. Other materials such as plastic and polymers and the like are also contemplated and fall with in the purview and scope of this patent. The strap includes first and second ends and has a means for tightening the strap in place. The first end of the strap is advantageously designed to attach to the bed frame or other rigid part of the bed or like furniture.

In its most common usage, the device is used by placing the base between the mattress and box springs or other portion of the bed or like piece of furniture. The strap is then run between the mattress and box springs and secured to the frame or other part of the bed on the opposite side of the bed from the device. The strap is then tightened in a manner that prevents the base from slipping out from between the mattress and box spring. Once the base is properly placed the user can grab a hold of the handle at any point and lower himself of herself onto the bed. The user may also maintain contact with the handle in order to position himself or herself on the bed in a position that is comfortable for sleeping. Likewise, if a user desires to get out of bed, the user may grab a hold of the handle at any point and use the handle to swing his or her legs off of the bed. Once in this position, the user can pull on the handle in order to rise into a standing position. Once standing, the user may remain in contact with the handle until he or she acquires the necessary stability or is otherwise able to move or walk away from the bed.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages or a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and objects of the invention are obtained can be appreciated, a more specific description of the invention briefly described above will be rendered y reference to the specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE EMBODIMENTS

Figure 1:
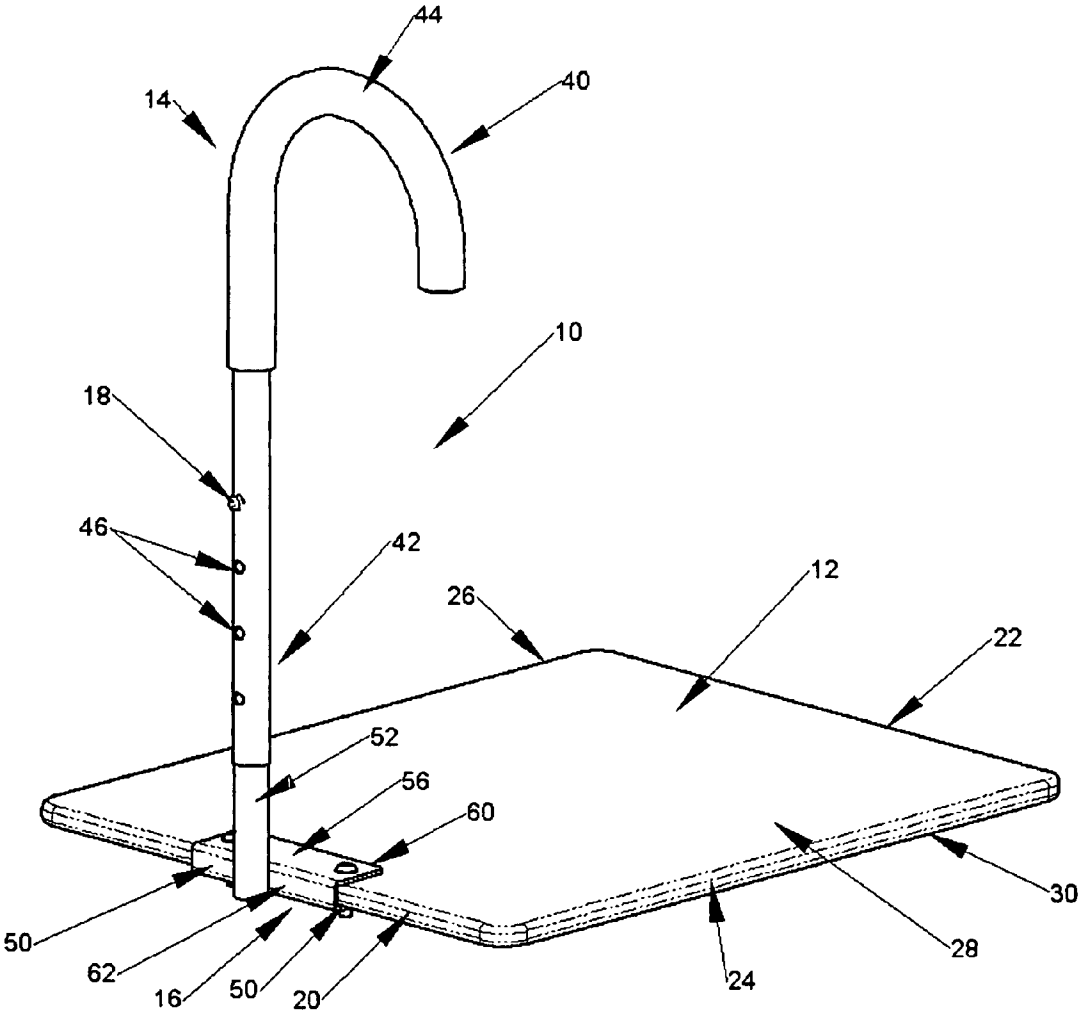
FIG. 1 is a front perspective view of the embodiment of the inventions, according to the principals and specifications contained herein.
Figure 2:
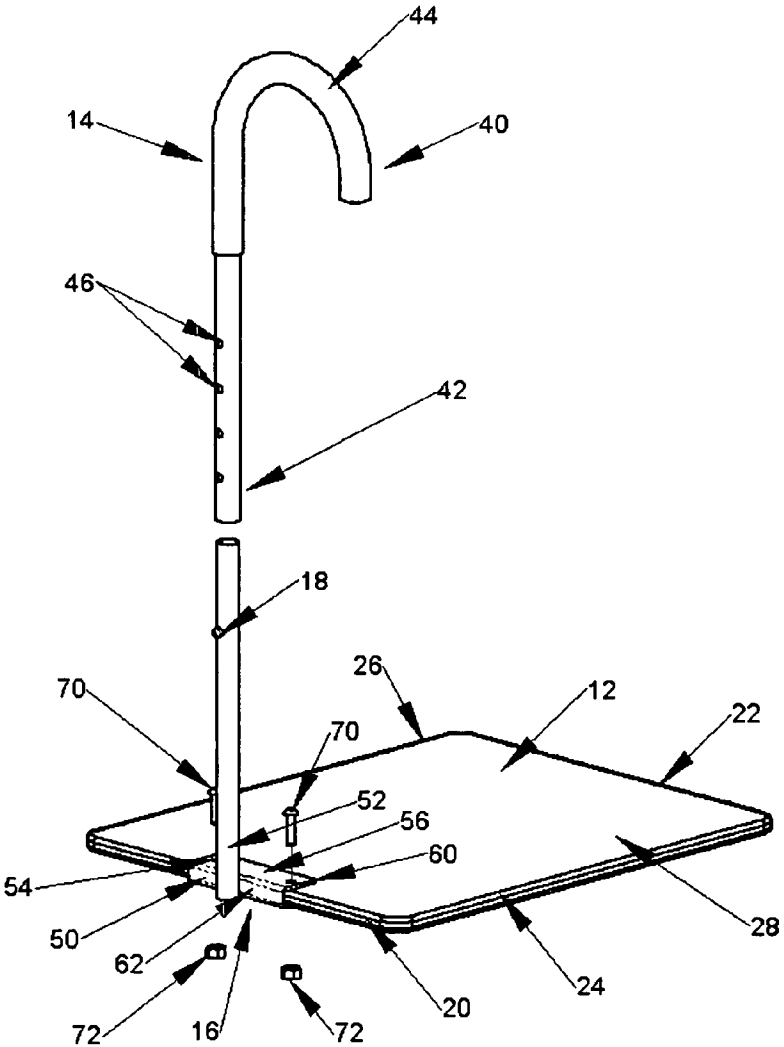
FIG. 2 is a front perspective view of the second end of the handle and the bracket.
Figure 3:
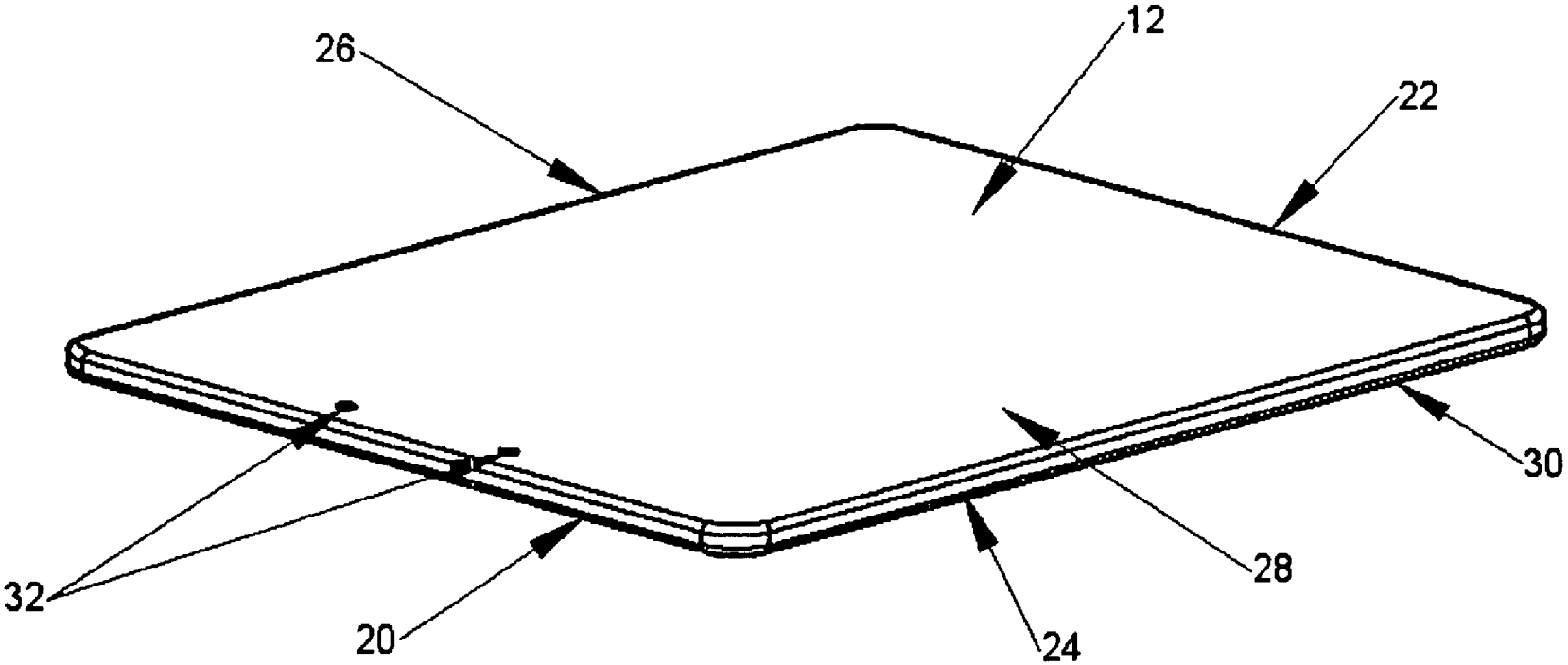
FIG. 3 is a side elevational view of the second end of the handle and the bracket in a hinged orientation.
Figure 4:
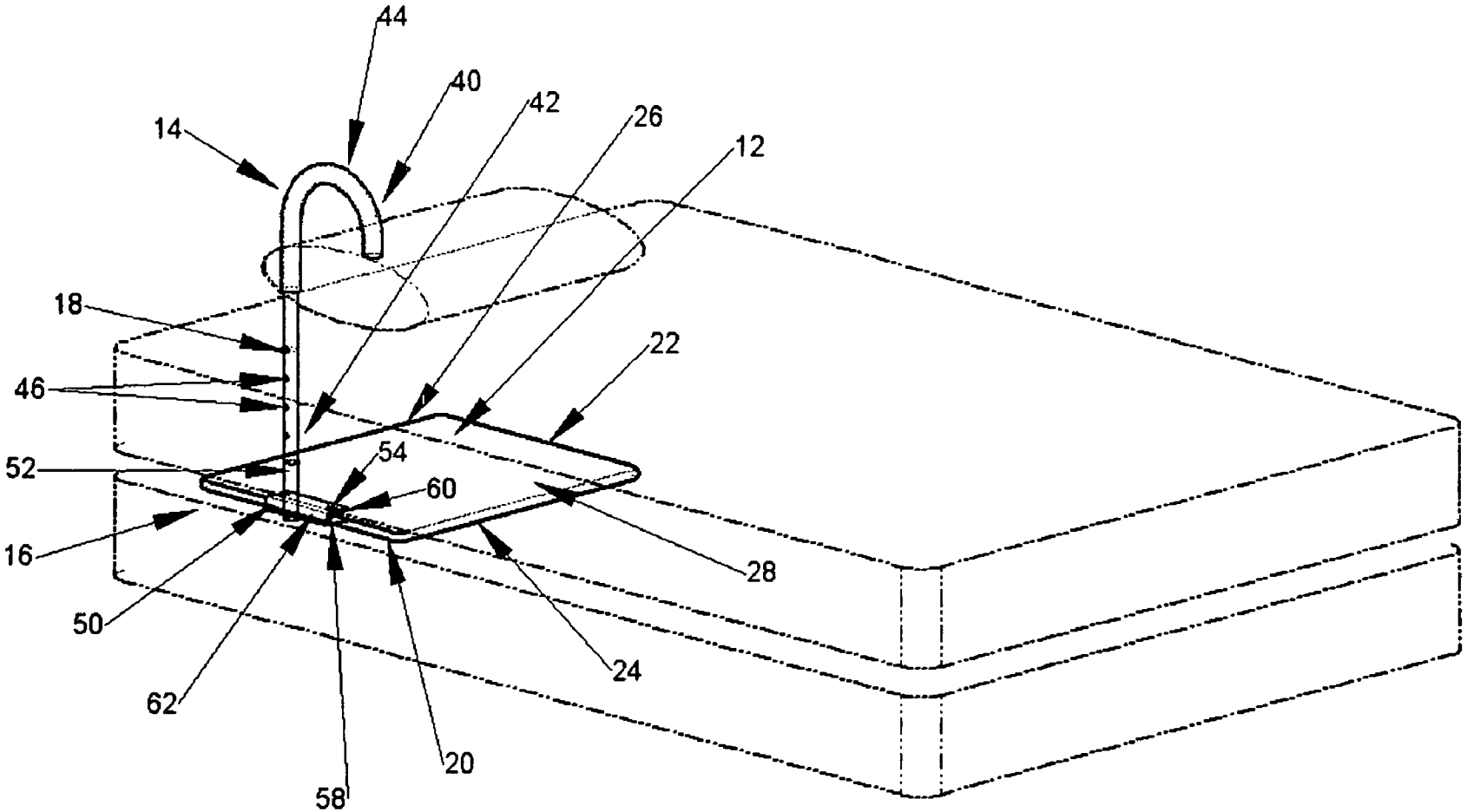
FIG. 4 is a side elevational view of the second end of the handle and the bracket in a locked position.
Figure 5:
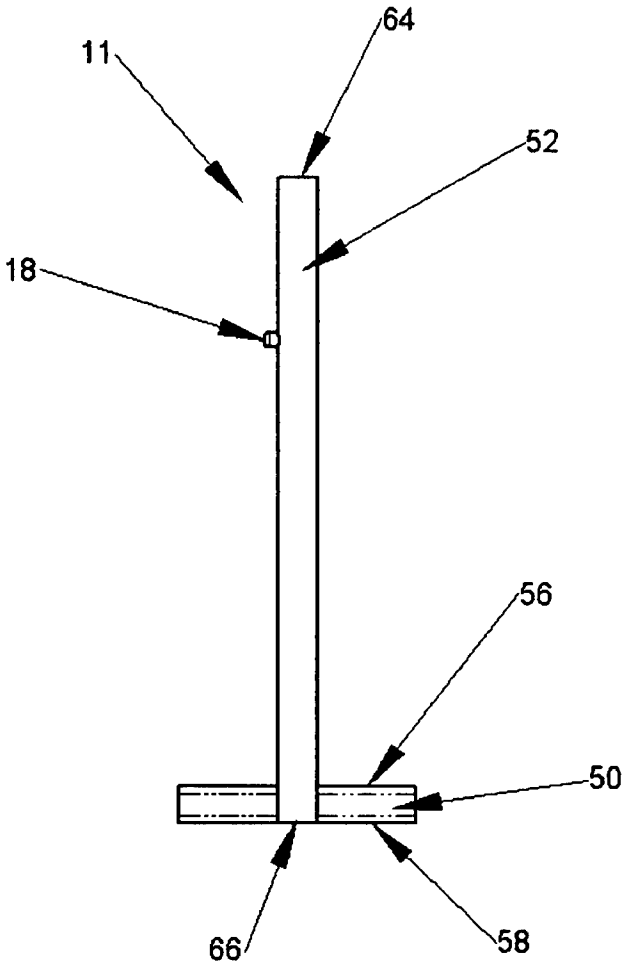
FIG. 5 is a top view of the bracket.
Figure 6:
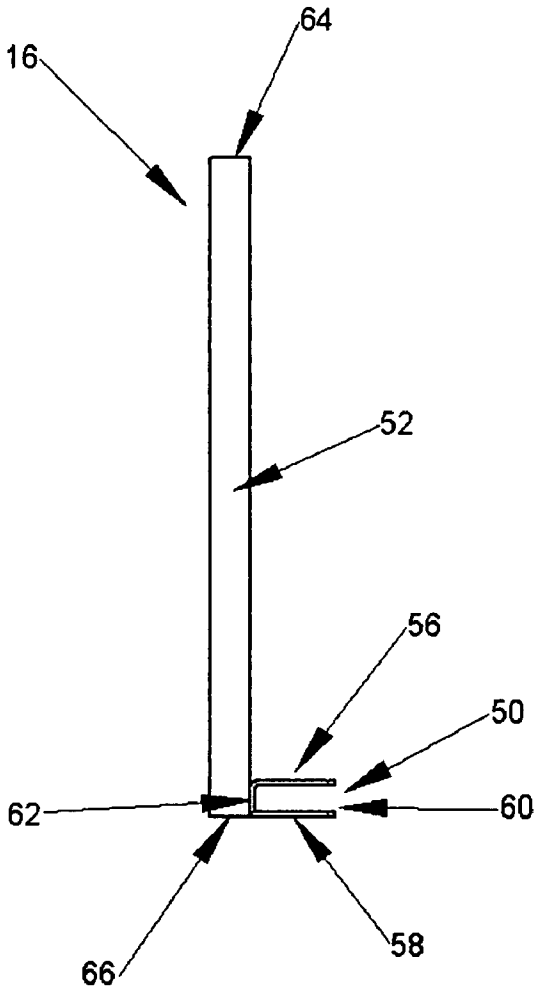
FIG. 6 is a perspective view of the embodiment of FIG. 1, showing the device in relation to a standard bed.
Figure 7:
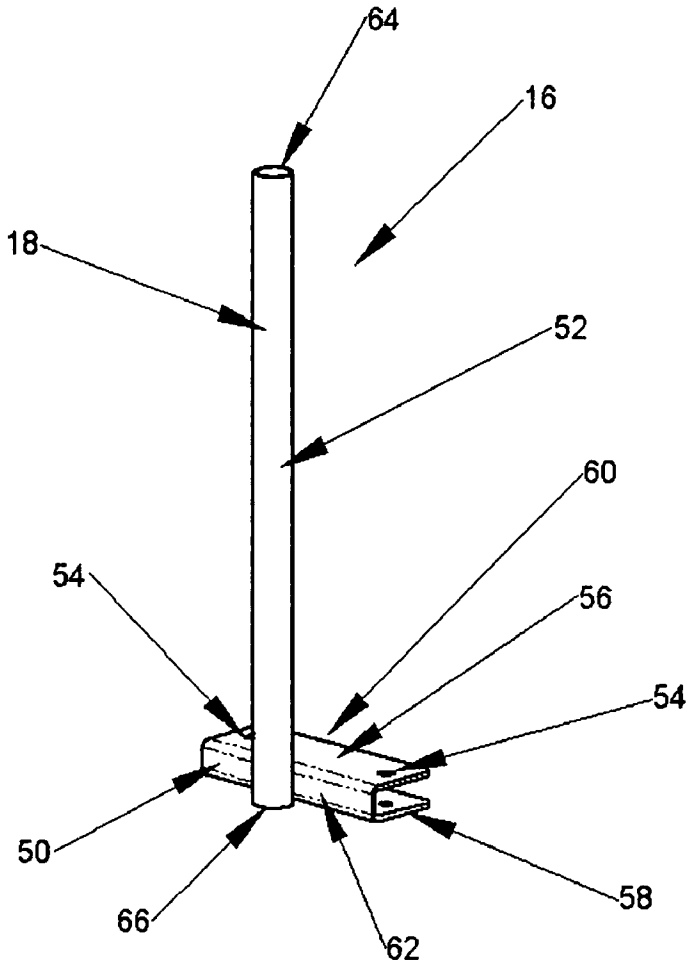
FIG. 7 is a perspective view of the embodiment of FIG. 1, showing the device in relation to standard bed with the strap placed between the mattress and box spring and anchored to the frame of the bed.
Figure 8:
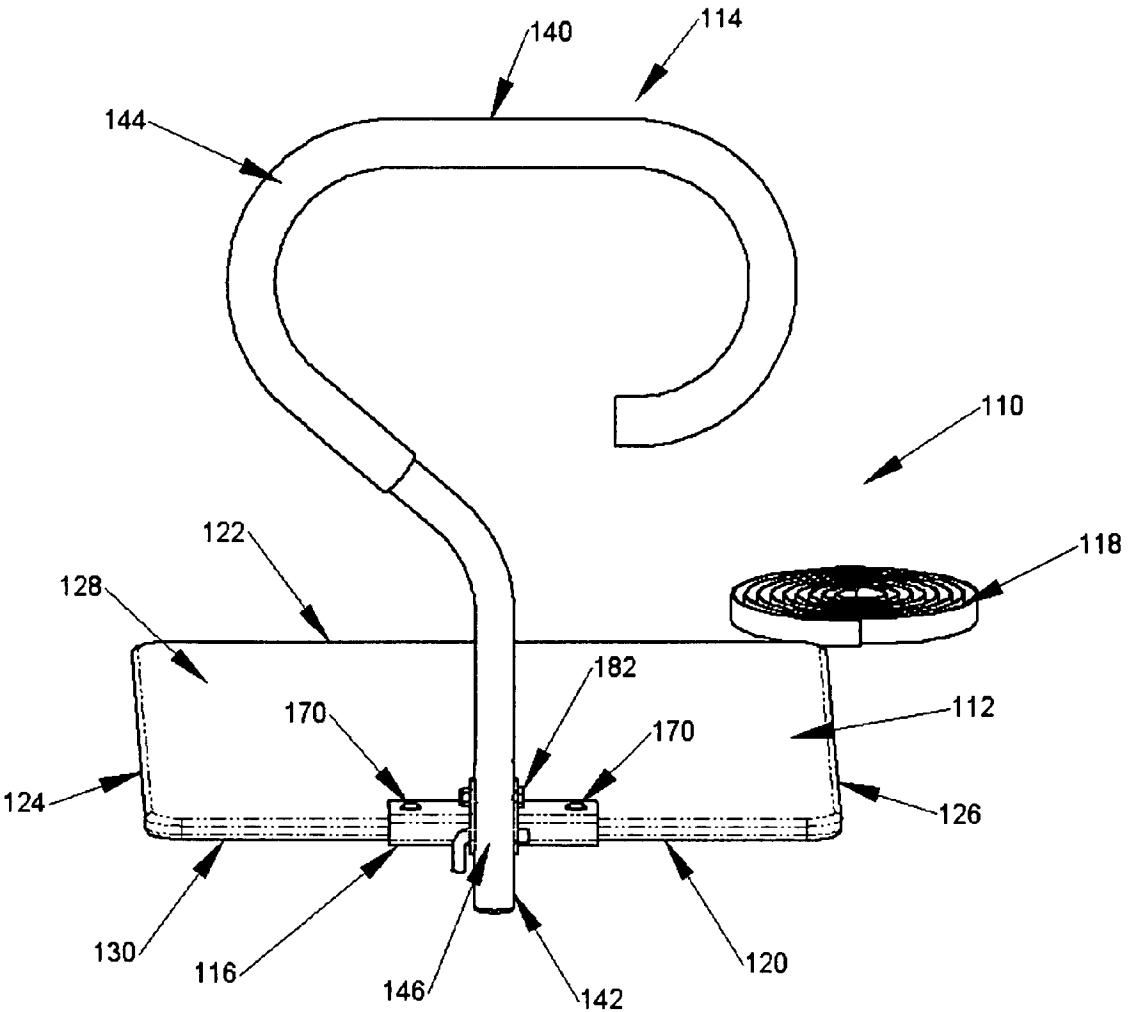
FIG. 8 is a isometric view of another embodiment of the broad invention.
Figure 9:
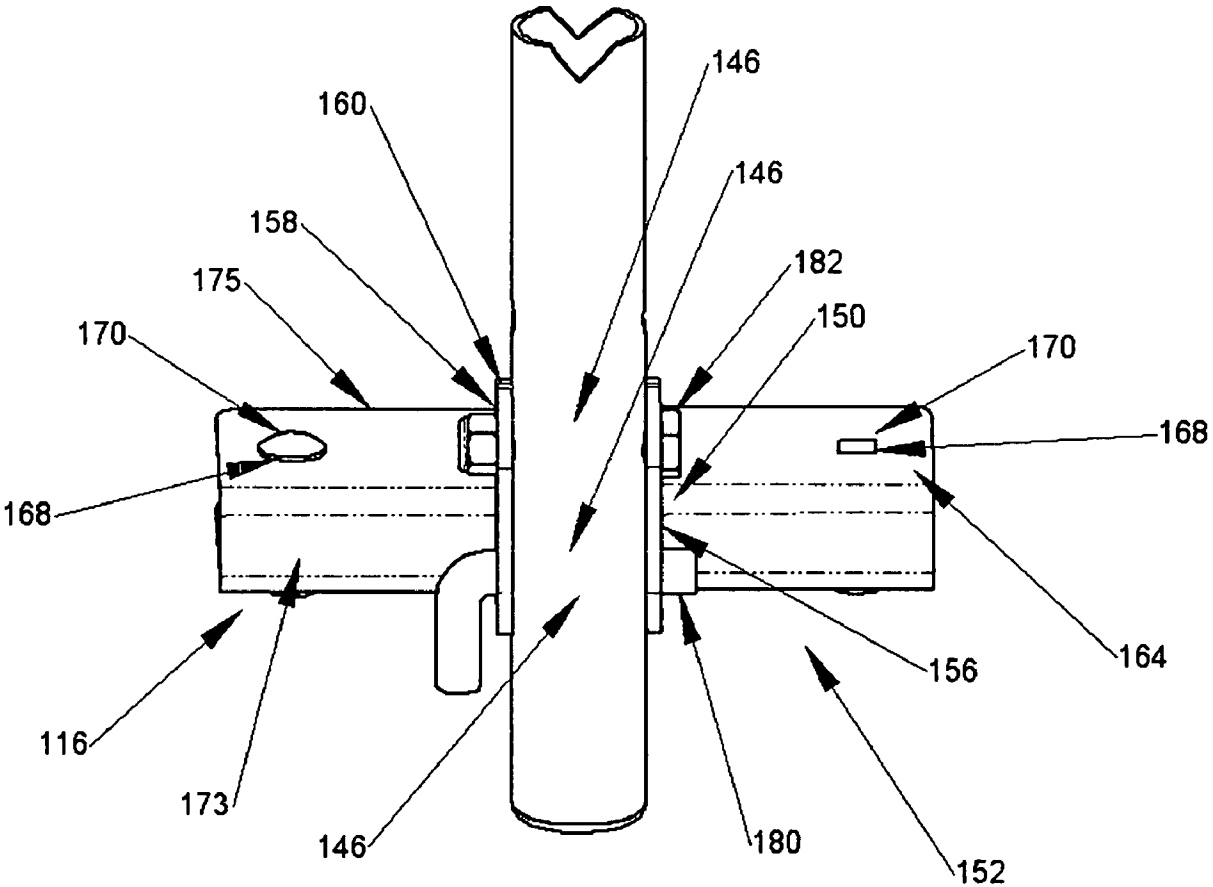
FIG. 9 is an isometric view of a part of the embodiment of FIG. 8.

Reference throughout this specification to "one embodiment", "an embodiment", or similar language means that a particular feature, structure, or characteristic described in connection with the embodiment is included in at least one embodiment of the present invention. Thus, appearances of the phrases "in one embodiment", "in an embodiment", and similar language throughout this specification may, but do not necessarily, all refer to the same embodiment.

Furthermore, the described featured, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Reference is now made to the drawings where in like numerals are used to designate like component parts throughout. The assist device of the present invention, generally designated 10, includes a base 12, a handle 14, a bracket 16, and an adjusting member 18. Each of these components will be described in greater detail hereafter.

Advantageously, the base 12 includes first and second ends 20 and 22, respectively, first and second longitudinal sides 24 and 26, respectively, and top and bottom faces 28 and 30, respectively. The base 12 is advantageously, designed to be large enough to provide a firm and stable base for the operation of the device. Advantageously, the base 12 is constructed out of rigid non-flexing material such as wood. Other material such as wood composites, plastics, polymers, steel, aluminum and the like are also contemplated and fall within the purview and scope of this patent. The first end 20 includes a plurality of holes or perforations 32 that transpose the base 12 from the top face 28 through the bottom face 30. as discussed in more detail below, the plurality of holes or perforations 32 are, in combination with a plurality of bolts and nuts 70 and 72, respectively, designed to anchor the bracket 16 to the base 12.

The handle 14 includes first and second ends 40 and 42, respectively. The first part 40 of the handle 14 includes a cane shape 44 that is advantageously designed to resemble and act like a cane handle in operation. The first end 40 of the handle 14 is coated or covered with a material or substance to prevent the user's hand from slipping during use. One skilled in the art will readily recognize that the coating or covering can be made of numerous materials to accomplish the end of creating a slip free surface and all the coating and covering are contemplated in this patent. The second end 42 of the handle 14 includes a plurality of holes or perforations 46. The second end 42 of the handle 14 is of slightly larger diameter that the receiving member of the bracket 16, as discussed more fully below. One skilled in the art will immediately recognize that the second end 42 of the handle 14 is designed to fit over the receiving member of the bracket 16 in order to properly activate the adjusting means 18, as discussed below. One skilled in the art will also immediately recognize that it would be possible to make the second end 42 of the handle 14 fit within the diameter of the receiving member of the bracket 16.

The bracket 16 includes both a u-shaped member 50 and a receiving member 52. The u-shaped member 50 includes a top and bottom flange 56 and 58, respectively, front and back aspects 60 and 62, respectively. The top and bottom flanges 56 and 58, respectively, are transposed by a plurality of holes or perforations 54. One skilled in the art will immediately recognize that the plurality of holes or perforations 54. One skilled in the art will immediately recognize that the plurality of holes or perforations 54 are designed to line up with the plurality of holes or perforations 32 in the base 12 for purposes of anchoring the bracket 16 to the base 12. The base 12 is designed between the top and bottom flanges 56 and 58, respectively, for purposes of anchoring the bracket 16 to the base 12. The receiving member 52 of the bracket 16 is generally tubular in shape and includes first and second ends 64 and 66, respectively. The second end 66 of the receiving member 52 is permanently anchored to the back 62 of the u-shaped member 50. The receiving member 52 is u-shaped member 50 are in a ninety-degree orientation to each other and, one skilled in the art, will immediately recognize that such a relationship places the receiving member 52 in a vertical orientation when the device 10 is fully assembled and in use. The first end 64 of the receiving member 52 included the adjusting member 18. One skilled in the art will immediately recognize that the second end 42 of the handle 14 is designed to fit over the first end 64 of the receiving member 52 or the bracket 16. One skilled in the art will further recognize that the height of the handle 14 relative to the base 12 can be adjusted by allowing the adjusting means to seat within the desired hole or perforation 46 located on the second end 42 of the handle 14. Moreover, one skilled in the art will also recognize that there are other embodiments of the bracket 16 than those shown in the drawings and that such embodiments are contemplated by and within the purview of this patent.

Referring now to FIG. 1-7 one skilled in the art will immediately recognize that the bracket 16 attached to the base 12 by placing the first end 20 of the base 12 between the top and bottom flanges 56 and 58, respectively, of the u-shaped member 50 of the bracket 16. One skilled in the art will further recognize that permanent anchoring between the bracket 16 and base 12 is accomplished by lining up the holes or perforations 54 in the top and bottom flanges 56 and 58, respectively, of the u-shaped member 50 of the bracket 16 with the holes or perforations 32 on the first end 20 of the base 12. Once the holes or perforations are aligned, permanent anchoring can be accomplished by inserting bolts 70 through the holes 54 in the top and bottom flanges 56 and 58, respectively, of the u-shaped member 50 of the bracket 16 and through the holes or perforations 32 on the first end 20 of the base 12 and anchoring the bolts 70 with respective nuts 72.

Still referring to the above referenced figures, one skilled in the art will comprehend that once the base 12 and bracket 16 are anchored together, the second end 42 of the handle 14 can be placed over the first end 64 of the receiving member 52 of the bracket 16. One skilled in the art will also recognize that it is necessary to depress the adjusting means 18 on the first end 64 of the receiving member 52 of the bracket 16 so that the handle 14 can fit over the end. By depressing the adjusting means, the handle 14 can be moved up and down vertically in relation to the first end 64 of the receiving member 52 of the bracket 16. By allowing the adjusting means 18 to extrude through different pluralities of holes or perforations 46 in the second end 42 of the handle 14, one skilled in the art will recognize that the user will be able to adjust the vertical height of the handle to accommodate all types of beds or like furniture as well as the particular individual needs of the user.

Still making reference to the above referenced figures, one skilled in the art will also recognize that the weight of the mattress, once the base 12 is properly positioned, will add stability to device 10 when in use. Once the device 10 has been properly positioned, the user can use the same by grasping the handle 14 and, during sitting down, can apply the necessary pressure to allow himself or herself to ease into a sitting position. The user can remain in contact with the handle 14 and swing his or her legs up onto the bed into the desired position. Conversely, a user desiring to sit up from a prone position may likewise grasp the handle 14 and, by applying increasing pressure, pull them self into a sitting position, while at the same time swinging their legs off the edge of the bed. From a sitting position, a use can then apply the necessary pressure to pull them selves from a sitting to a standing position. One skilled in the art will further recognize that the user may hang onto the handle until they have attained enough stability of confidence to begin walking away from the bed chair or like piece of furniture.

Referring to FIGS. 8-14 generally, there are illustrated another embodiment of the assistance device similar to that illustrated in the previous figures. Specifically, the assistance device is designated as 110, and includes a base 112, a handle 114 and a bracket 116. Each of these components will be described in greater detail hereafter. Advantageously, the base 112 includes first (front) and second (back) ends 120 and 122, respectively, first and second longitudinal sides 124 and 126, respectively, and top and bottom broadfaces 128 and 130, respectively. The base 112 is advantageously designed to be large enough to provide a firm and stable base for the operation of the device. Advantageously, the base 112 is preferably constructed out of rigid non-flexing material such as wood. Other materials such as wood composites, plastics, polymers, steel, aluminum and the like are also contemplated and fall within the purview and scope of this patent. The first end 120 includes a plurality of holes or perforations 132 that transpose the base 112 from the top broadface 128 through the bottom broadface 130. There are a plurality of holes 168 that are designed to receive a plurality of bolts and nuts 170 and 172, respectively, designed to anchor the bracket 116 to the base 112.

The handle 114 includes first and second ends 140 and 142, respectively. The first part 140 of the handle 114 includes a shape or bend 144 that is advantageously designed to create a mini-rail running above, horizontal to and parallel with the top of the mattress 171. The first end 140 of the handle 114 is optionally coated or covered with a material or substance to prevent the user's hand from slipping during use. One skilled in the art will readily recognize that the coating or covering can be made of numerous materials to accomplish the end of creating a slip free surface and all the coatings and coverings are contemplated in this patent. In one embodiment, the second end 142 of the handle 114 includes a plurality of holes or perforations 146. The holes or perforations 146 are designed to align to the bracket 116.

FIGS. 9-12 specifically refer to the bracket 116 in more detail. The bracket 116 includes a first and second generally u-shaped member 150 and 152 respectively that are coupled to each other in a cross-wise fashion. The first u-shaped member 150, is designed to fit over the base section 142 of the handle 114, and includes both right and left flanges 156 and 158, respectively, and front and back portions (aspects) 160 and 162, respectively. The right and left flanges 156 and 158 each include at least two vertically oriented holes or perforations 154.

The second u-shaped member 152, is designed to fit over the base 112. The member 152 includes both top and bottom flanges 164 and 166, respectively, and front and back portions (aspects) 173 and 175, respectfully. There are a plurality of holes or perforations 168 through the top and bottom flanges 164 and 166.

Figure 10:
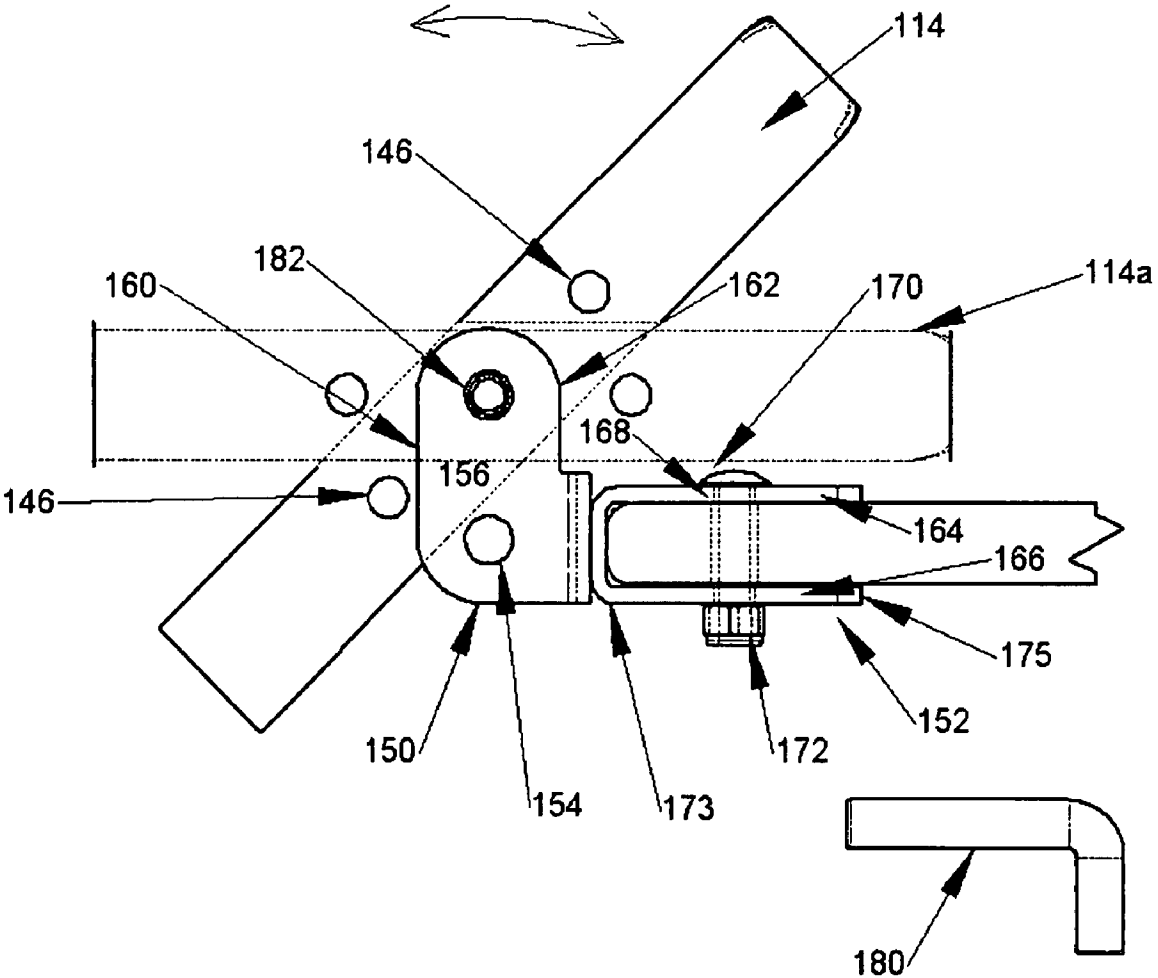
FIG. 10 is a side view of FIG. 9 in one position.
Figure 11:
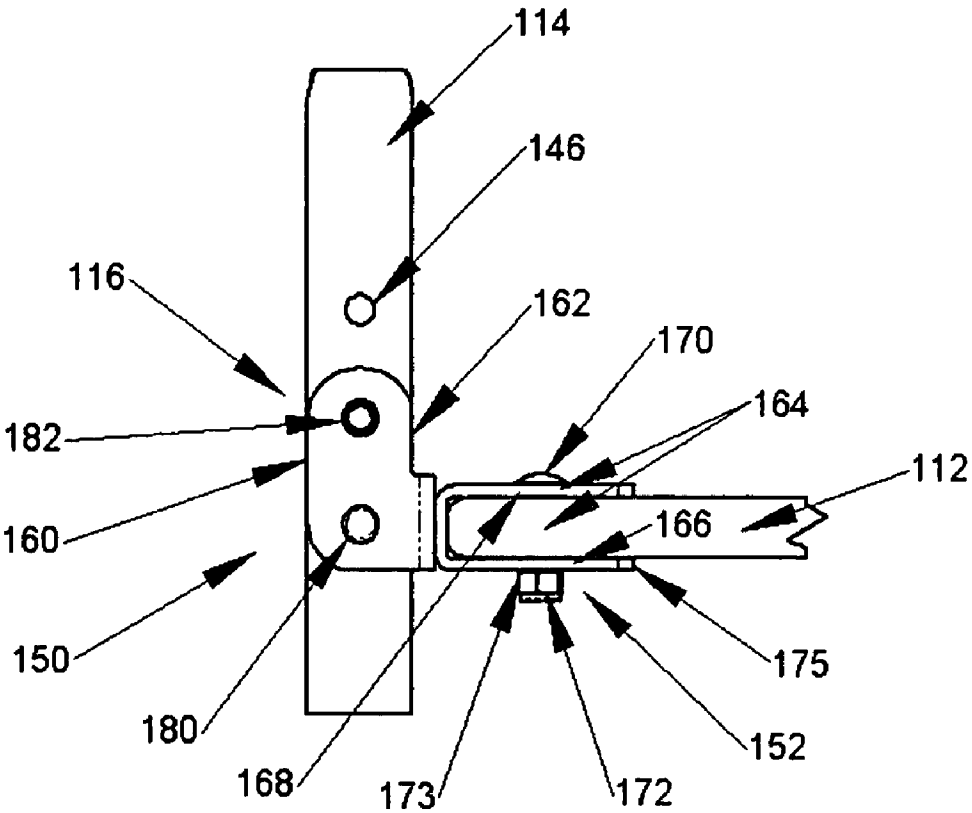
FIG. 11 is a side view of FIG. 9 in another position.
Figure 12:
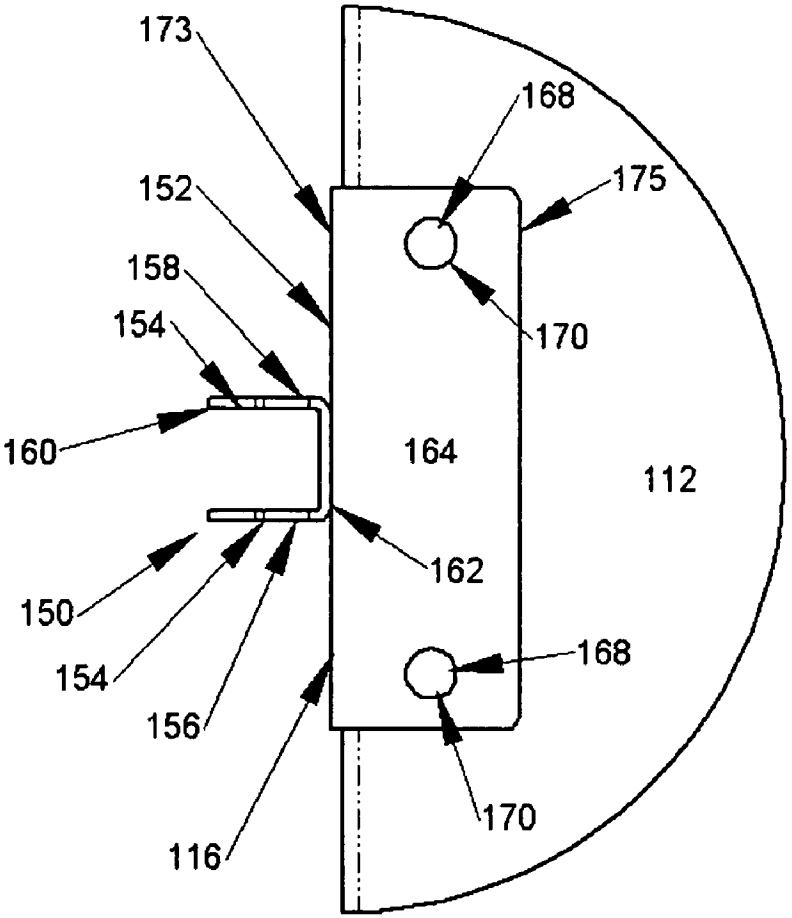
FIG. 12 is a top view of a portion of the embodiment of FIG. 9.
Figure 13:
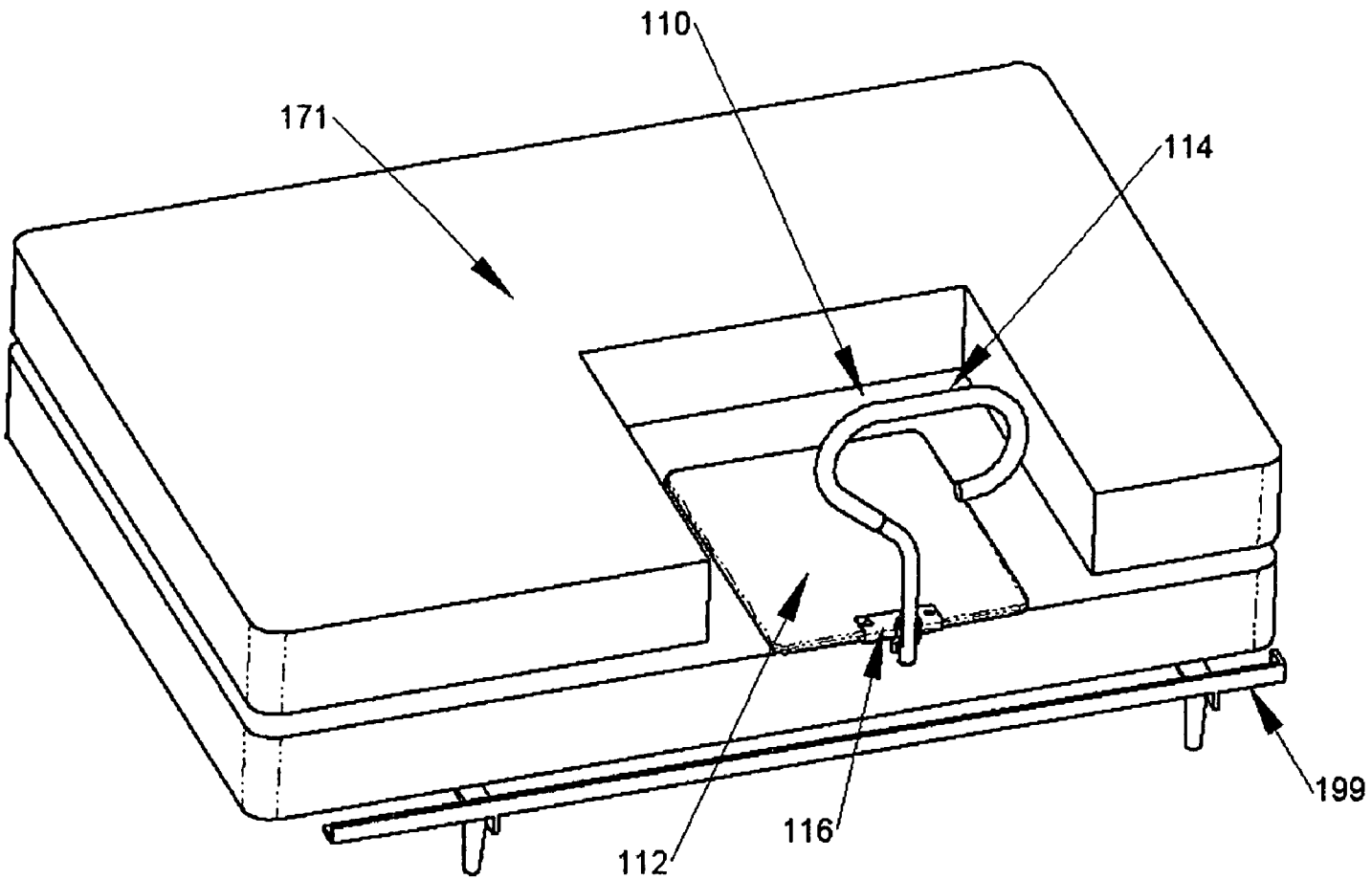
FIG. 13 is a sectional view of the embodiment of FIG. 8 as used on a bed.

FIGS. 10 and 11 specifically teach the aspect of pivoting the handle 114 with respect to the base 112. First, it is important to note that the plurality of holes or perforations 154 in the right and left flanges 156 and 158 are designed to line up with the plurality of holes or perforations 146 in the second end 142 of the handle 114. This alignment allows the handle 114 to be mounted thereto, as illustrated in FIG. 11. However, as illustrated in FIG. 10, once the removable retaining device 180, illustrated as an L-shaped piece, is removed from the respective holes 154 and 146, the handle 114 is now capable of pivoting about the retainer 182, which is now acting as an axel, so that the handle 114*a* (reclined position) can be positioned relatively parallel and proximate to the base 112. In this prone or folded position, the overall assistance device 110 can be folded and stored away in a more contact position without requiring significant disassembly of the bolts or requiring removal of the handle 114 from the base 112 as required in prior art designs.

The holes 168 in the top and bottom flanges 164 and 166, respectively, of the second u-shaped member 152 of the bracket 116 are designed to line up with the plurality of holes or perforations 132 of the base 112 for purposes of anchoring the bracket 116 to the base 112. The base 112 is designed to fit between the top and bottom flanges 164 and 166, respectively, for purposes of anchoring the bracket 116 to the base 112.

Figure 14:
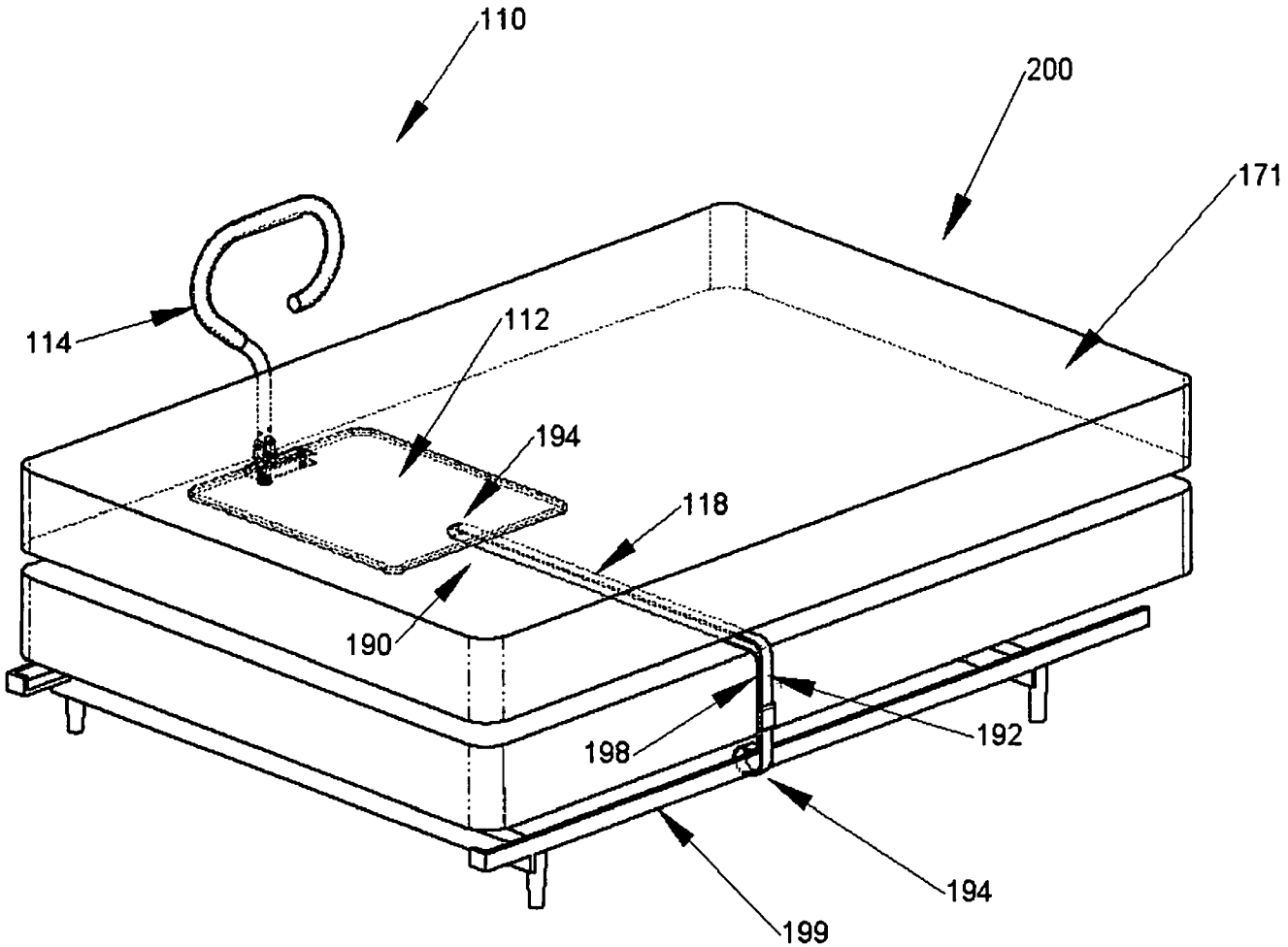
FIG. 14 is another sectional view of the embodiment of FIG. 8 as used on a bed.

FIG. 14 focuses on the operation of the strap 118. The strap 118 comprises first and second ends 190 and 192, respectively. The first end 190 of the strap 118 includes and attaching member 194 for attaching to the base 112. The second end 192 of the strap 118 consists of a hook 194 to attach to the frame 199 or other rigid part of the bed or like furniture 200. The strap 118 includes any known means 198 for tightening the strap. The weight of the mattress, once the base 112 is properly positioned, will add stability to device 110 when in use. Once the device 110 has been properly positioned, the user can grab the handle 14 and, while sitting down, can apply the necessary pressure to allow them self to ease into a sitting position. The user can remain in contact with the handle 114 and, by applying increasing pressure, pull themselves into a sitting position, while at the same time swinging their legs off the edge of the bed. From a sitting position, a user can then apply the necessary pressure to pull themselves from a sitting to a standing position. One skilled in the art will further recognize that the user may hang onto the handle until they have attained enough stability or confidence to begin walking away from the bed chair or like piece of furniture.

Figure 15:
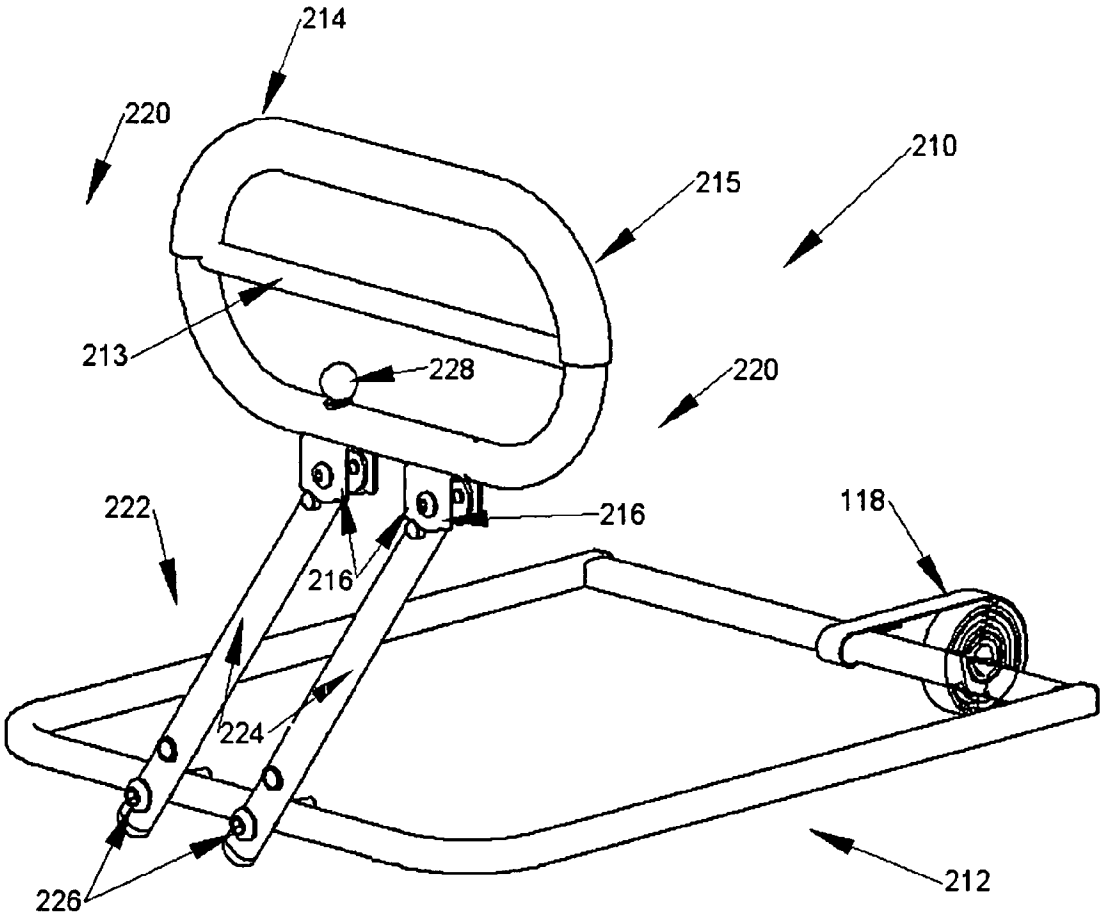
FIG. 15 is another embodiment of the illustrated embodiment with additional features.

FIG. 15 is another embodiment of the illustrated assistance device 210 with additional features. The assistance device 210, has a base 212, illustrated as being formed out of squared tubing, an attachment strap 118, and handle 214. As illustrated, handle 214 is formed into a circular or oval design with a central connection rail 213, with the top portion of the handle 214 being covered with a non-skid covering 215. In this embodiment, the handle 214 is adjustable 220 in a right and left rotation as illustrated. As Illustrated, the handle 214 is rotated to the right from a vertical position 222. In this embodiment, there are illustrated two brackets 216, for support strength, which are attached to the bottom side of the handle 214 in any known fashion. Two legs 224 are rotatably coupled between the respective brackets 216 and the base 212. Two axels 226, illustrated as two bolts extending through the legs and base, attach the two respective legs 224 to the base 212. A control handle 228 is positioned above one of the legs 224 above the bracket 216 as illustrated. The control handle 228 is designed to retain the leg 224 in any known fashion, but is illustrated to be spring loaded to be pull in a vertically upward position to release the locking function so that the leg 224 may be rotated to the right or left. In one embodiment, it is contemplated to have the control handle 228 lock the legs 224 in a vertical position. It is also contemplated to design the control handle 228 to lock the legs 224 in several positions besides the vertical position, like a twenty degree tilt to the right or left, to assist the user in accessing the desired sitting position. It is noted that the purpose for having the handle 214 rotated is to allow a person to have the handle close to the user to get into the desire position, but to also allow the user to move the handle out of that position to allow for more access for the user. For example, in a reclined position, it is noted that the vertical position may hamper the elbow of the user while reclining in a bed. So you allowing the handle to be rotated, the handle will no longer be a hindrance. It is noted that other embodiments could use a single leg 224 and respective supporting hardware to accomplish the support and rotation of the handle 214. It is noted that the handle 214 is designed to optionally maintain a horizontal orientation to the base while pivoting 220 and while being locked in a pivoted position from the horizontal position. In this fashion, the top of the handle 214 will be parallel to the top of the furniture, like a bed, in any fixed position, to best assist a person using the assistance device 210.

Figure 16:
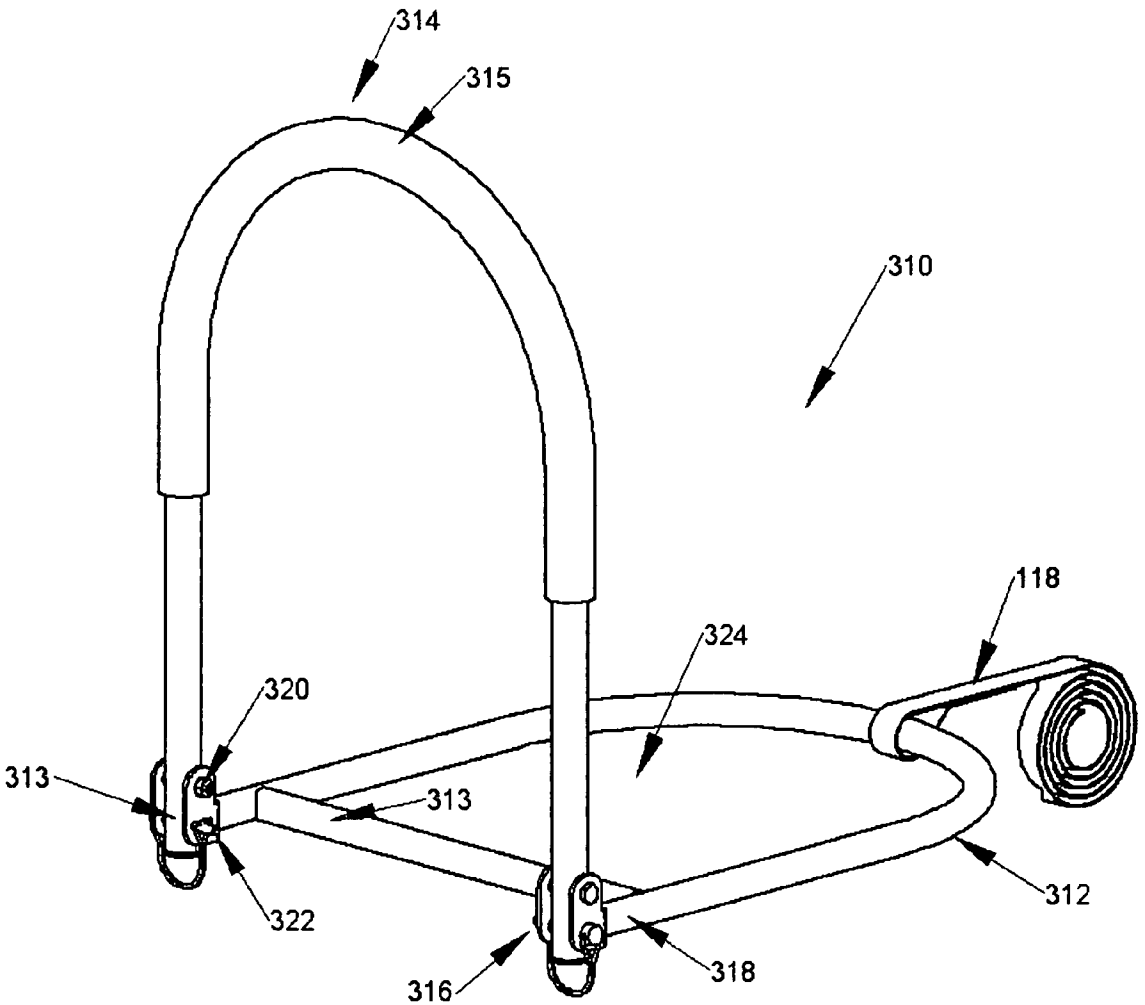
FIG. 16 is an isometric view of a further embodiment of the general invention.

FIG. 16 is a view of a further embodiment of the general invention. The illustrated assistance device 310 included a base 312 that is illustrated as being formed unto a u-shaped tube with a cross member 313. There is a handle 314 that is illustrated as being a u-shaped tube with an upper end being covered with a non-slip material 315. There is a bracket 316 coupled to the base 312 at the ends 318 of the u-shaped tube base section. The ends 313 of the u-shaped handle 314 are coupled to the bracket 316 by a fixed axel 320 and a removable anchor 322. When the anchor 322 attached the handle 314 to the bracket 316, also referred to as a locked position, the handle will form a ninety degree angle with the base 312. When the anchor 322 is removed, also referred to as an unlocked position, the handle 314 will rotate 324 about the axel 320 so that the handle is parallel to the base 312. The axel 320 is positioned sufficiently above the top surface of the base 312 so that the handle 314 will be able to be parallel to the base 312, similar to that illustrated in FIG. 10. Thus, the entire assistance device 310 can be folded into a compact flat shape without removing the handle from the base and bracket.

It is noted that most any shape may serve as a base portion 312. The illustrated shapes of bases 312, 212, and 12 are illustrated for their efficient design and ease of manufacturing.

Although the preferred embodiment of the present invention have been illustrated and described, it is to be understood that the present disclosure is made by way of example and illustration and various other embodiments are possible without departing from the subject matter coming within the scope of the following claims, which subject matter is regarded as the invention.

The invention claimed is:

1. An assistance device for assisting a user in getting into and out of various positions on a piece of furniture, comprising:

a base having dimensions configured to fit under a cushion-type portion of the furniture;

a first bracket coupled to a portion the base the first bracket comprising at least two flanges; and a pivoting handle having first and second ends, the first end comprising a single leg, the single leg providing the only support to the handle, the first end coupled to the first bracket through an axle and a disengagable anchor, the axle comprising a pin extending transversely through the flanges of the bracket and first end of the handle such that the axle is substantially parallel to the portion of the base coupled to the bracket and the disengagable anchor comprising a pin that extends transversely through the bracket and first end of the handle, such that the handle is positionable in a vertical position substantially perpendicular relative to the base, wherein the handle is configured to pivot about the axle to a reclined position approximately parallel to the base when the anchor is disengaged from the first bracket, such that the axle maintains the handle in a fixed pivoting position preventing movement of the handle in a vertical direction substantially perpendicular relative to the base, the first end extending beyond the axle, such that when the handle is in the vertical position the first end abuts the first bracket in such a manner to prevent the handle from pivoting in a direction away from the cushion-type portion of the furniture, and the second end being free and not coupled to any structure, wherein the handle has an arcuate shape, such that the portion configured to be grasped by the user is in the shape of a hook;

wherein the base comprises a single rigid planar member having a width that extends on both sides of the single leg and across a substantial width of a cushion under the cushion-type portion of the furniture, the base further provides support to the handle without the base or handle receiving direct support from the ground, and wherein the bracket is configured to restrain the handle in the vertical position such that the handle is incapable of rotating in a plane formed by the handle.

2. The assistance device of claim 1, further comprising a strap having a first end and a second end, the first end attached to the base and the second end being configured to attach to a frame or other rigid portion of the furniture on an opposite side from where the handle is positioned.

3. An assistance device for assisting a user in getting into and out of various positions on a piece of furniture, comprising:

a base comprising a single rigid member having dimensions configured to fit under a cushion-type portion of furniture, such that the dimensions of the base are coplanar and are configured to extend across a substantial width of a cushion of the cushion-type portion of furniture;

a pivoting handle to provide support for the user, the handle having first and second ends, the first end of the pivoting handle coupled to the base such that the base provides support to the handle without the base or handle receiving direct support from the ground, the first end comprising a single leg, the single leg providing the only support to the handle, and the second end of the handle being free and not coupled to any structure, wherein the handle has an arcuate shape, such that a portion configured to be grasped by the user is in the shape of a hook;

a first bracket interconnecting the base and the handle, the bracket comprising at least two flanges; and an axle and a disengagable anchor for coupling the handle to the first bracket, the axle comprising a pin extending transversely through the bracket and first end of the handle such that the axle is substantially parallel to the bracket and a disengagable anchor comprising a pin that extends transversely through the bracket and handle, the anchor being configured extend through the flanges of the bracket;

wherein the handle is secured in a vertical position substantially perpendicular to the base when both the axle and the disengageable anchor couple the handle to the first bracket, and the handle is configured to pivot about the axle to a reclined position adjacent the base when the anchor is disengaged from the bracket, such that the axle maintains the handle in a fixed pivoting position preventing movement of the handle in a vertical direction substantially perpendicular relative to the base and the flanges of the bracket are configured to render the handle incapable of rotating in a plane formed by the handle, the handle including a portion extending beyond the axle, such that when the handle is in the vertical position the extending handle portion abuts the first bracket in such a manner to prevent the handle from pivoting in a direction away from the cushion-type portion of furniture, and wherein the single rigid planar member has a width that extends on both sides of the single leg.

4. The assistance device of claim 3, further comprising a strap having a first end and a second end, the first end attached to the base and the second end configured to attach to a frame or other rigid portion of the furniture.

5. The assistance device of claim 3 wherein the handle is substantially parallel to the base in the reclined position.

6. An assistance device for assisting a user in getting into and out of various body positions on a piece of furniture comprising:

an arcuate U-shaped base having a horizontal and vertical dimension configured to fit under a cushion-type portion of the furniture, the U-shaped base having a first and second end facing a same direction, the first and second ends rigidly connected through a U-shaped portion of the base;

a first and second attachment bracket coupled to the first and second end of the base respectively, each bracket comprising at least two flanges;

an arcuate U-shaped handle having a first and second handle end respectively coupled to the first and second brackets to enable the handle to maintain a vertical position with respect to the base while in a locked position, and to maintain a folded position with the handle being parallel to the base while in an unlocked position, the base providing support to the U-shaped handle without the base or U-shaped handle receiving direct support from the ground, wherein the U-shaped handle is coupled to the first and second brackets each through a fixed axle and a removable anchor, each fixed axle and removable anchor comprising pins that extend transversely and completely through the flanges of each bracket and the first and second ends of the U-shaped handle, in a direction substantially perpendicular to the direction that the first and second base ends face, such that each removable anchor is completely removed from the brackets when the handle is in the unlocked position and each fixed axle maintains the U-shaped handle in a fixed pivoting position preventing movement of the U-shaped handle in a vertical direction substantially perpendicular relative to the base;

wherein, the first and second handle ends each extend beyond their respective axle, such that when the handle is in the vertical position the first and second ends abut the first and second bracket, respectively, in such a manner to prevent the handle from pivoting in a direction away from the cushion-type portion of furniture.

7. The assistance device of claim 6, wherein the base is formed of a tubular member.

8. The assistance device of claim 6, wherein the first and second brackets each comprise an axle coupled to the bracket and respective first and second ends of the handle to allow the handle to rotate about the axles.

9. The assistance device of claim 6, wherein the removable anchors are configured to retain the handle in the vertical position when coupled to both the handle and first and second brackets, but allows for the folded position of the handle when the removable anchor is dislocated from connecting to both the first and second brackets and the handle.

10. The assistance device of claim 6, further comprising a stabilizing cross member attached near the first end and second end of the U-shaped base.

11. The assistance device of claim 6, wherein the U-shaped base and the U-shaped handle are configured to be aligned with each other when in the folded position.

* * * * *

UNITED STATES PATENT AND TRADEMARK OFFICE

CERTIFICATE OF CORRECTION

PATENT NO. : 7,472,445 B2
APPLICATION NO. : 11/372779
DATED : January 6, 2009
INVENTOR(S) : Troy Miller It is certified that error appears in the above-identified patent and that said Letters Patent is hereby corrected as shown below:

Column 1, Line 31 reads, “These include beds an like pieces...” which should read, “These include beds and like pieces...”

Column 1, Line 32 reads, “...contain motors which area designed to...” which should read, “...contain motors which are designed to...”

Column 1, Lines 44-45 read, “...cause the device to awkward...” which should read, “...cause the device to be awkward...”

Column 2, Line 9 reads, “In most instances, these devices cost...” which should read, “In most instances, those devices cost...”

Column 2, Line 16 reads, “Most of these devices so not have any bars...” which should read, “Most of these devices do not have any bars...”

Column 2, Line 50 reads, “...has a handle that can grab...” which should read, “...has a handle that users can grab...”

Column 3, Line 4 reads, “...aspect of the present invention a...” which should read, “...aspect of the present invention is a...”

Column 3, Line 62 reads, “...accept the send end of the handle.” which should read, “...accept the second end of the handle.”

Column 4, Line 33 reads, “...lower himself of herself...” which should read, “...lower himself or herself...”

Column 5, Line 6 reads, “...will be rendered y reference...” which should read, “...will be rendered by reference...”

Column 6, Lines 49-50 read, “One skilled in the art will immediately recognize that the plurality of holes or perforations 54.” which should be deleted.

Column 7, Line 56 reads, “From a sitting position, a use can...” which should read, “From a sitting position, a user can...”

UNITED STATES PATENT AND TRADEMARK OFFICE

CERTIFICATE OF CORRECTION

PATENT NO. : 7,472,445 B2
APPLICATION NO. : 11/372779
DATED : January 6, 2009
INVENTOR(S) : Troy Miller It is certified that error appears in the above-identified patent and that said Letters Patent is hereby corrected as shown below:

Column 9, Line 59 reads, "So you allowing the..." which should read, "So by allowing the..."

Column 10, Line 40 reads, "...a first bracket coupled to a portion the base...." which should read, "...a first bracket coupled to a portion of the base..."

Column 11, Line 18 reads, "...comprising a single rigid member..." which should read, "...comprising a single rigid planar member..."

Signed and Sealed this

Tenth Day of November, 2009

David J. Kappos

David J. Kappos
*Director of the United States Patent and Trademark Office*